United States Patent [19]

Bauer

[11] 4,077,176

[45] Mar. 7, 1978

[54] TRUSS JOISTS

[76] Inventor: Frederick Bauer, 6913 E. Diamond St., Scottsdale, Ariz. 85257

[21] Appl. No.: 733,291

[22] Filed: Oct. 18, 1976

[51] Int. Cl.[2] ..... E04C 3/18

[52] U.S. Cl. ..... 52/693; 52/692; 52/694

[58] Field of Search ..... 52/693, 694, 376, 702, 52/262, 696, 753 C, 753 L, 639, 751, 90, 642, 511, 579, 289, 692; 85/11; 403/217, 394, 230

[56] References Cited

U.S. PATENT DOCUMENTS

| | | | |
|---|---|---|---|
| 2,684,134 | 7/1954 | Ruppel | 52/262 |
| 2,902,951 | 9/1959 | Maag | 52/692 |
| 3,137,899 | 6/1964 | Troutner | 403/217 X |
| 3,268,251 | 8/1966 | Troutner | 52/262 X |
| 3,330,087 | 7/1967 | Troutner | 52/693 |
| 3,397,502 | 8/1968 | Simpson, Jr. | 52/376 |
| 3,422,591 | 1/1969 | Troutner | 52/693 |
| 3,475,044 | 10/1969 | Konstant | 403/217 |
| 3,570,204 | 3/1971 | Birkemier | 52/289 |
| 3,857,218 | 12/1974 | Gilb | 52/692 X |
| 4,007,573 | 2/1977 | Gilb | 52/693 X |

*Primary Examiner*—Price C. Faw, Jr.
*Assistant Examiner*—Robert C. Farber
*Attorney, Agent, or Firm*—Cahill, Sutton & Thomas

[57] ABSTRACT

A truss joist includes an upper chord, a lower chord and a series of links. The series of links connects the upper and lower chord and terminates in an end link which is attached to the lower chord and extends upwardly toward the terminal portion of the upper chord. An end bracket which partially surrounds the terminal portion of the upper chord includes a U-shaped channel which contacts the side and bottom surfaces of the upper chord. The U-shaped channel further comprises a pair of downwardly projecting legs for connectively receiving the flattened end portion of the end link. One embodiment of the end bracket lies directly upon the upper surface of a support member. Another embodiment is flush-mounted against the inner surface of the support member and has a horizontal flange which extends over the upper surface of the support member. Additional embodiments of the end bracket include adjustable bracket elements mounted below the U-shaped channel and on either side of the downwardly projecting legs. Since those adjustable end brackets are slidably connected to the end bracket, they allow the length of the truss joist to be adjusted. These adjustable bracket elements include flat end surfaces which permit them to be nailed to the inner surface of the support member and thereby assist in securing the end bracket to the support member.

17 Claims, 10 Drawing Figures

TRUSS JOISTS

BACKGROUND OF THE INVENTION

1. Field of the Invention

Figure 1:
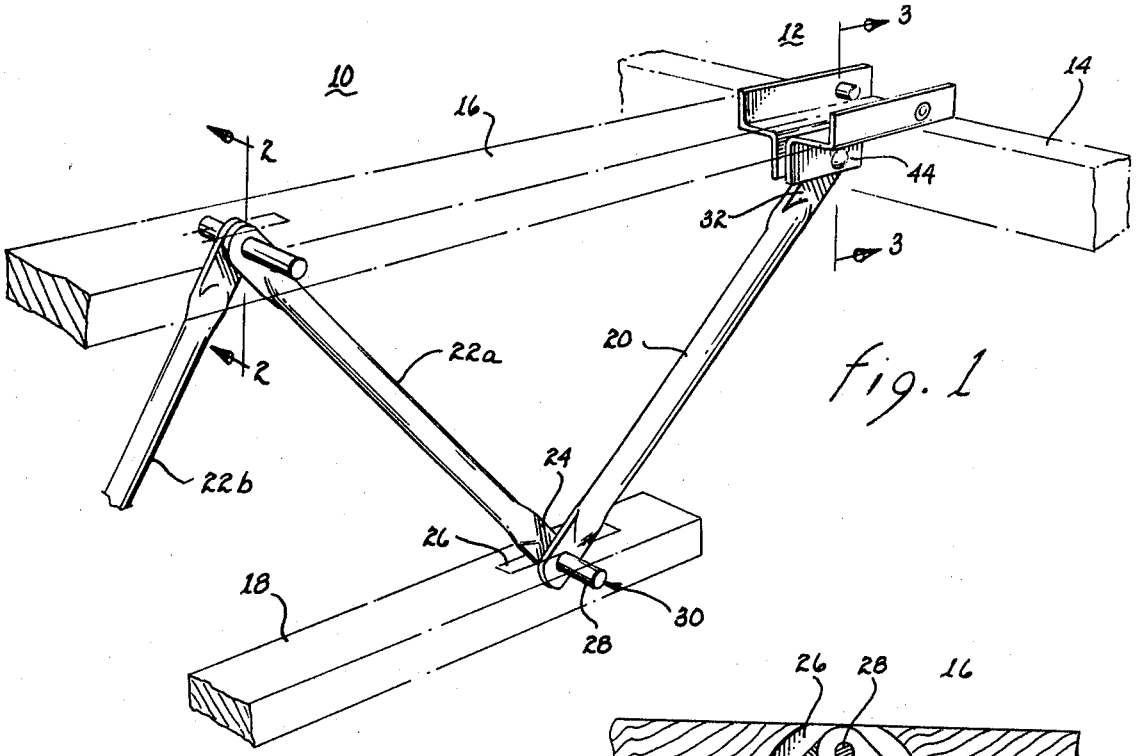

This invention relates to truss joists and, more particularly, to truss joists with open-top end brackets.

2. Description of the Prior Art

In the design and manufacture of truss joists there are two competing requirements:

1. that the truss joists bear the heaviest possible load; and 2. that the truss joists be constructed of the least expensive variety of wood, such as two-by-fours, in order that the total cost of each truss joist be held to a minimum.

In order to reduce the cost and weight, a truss joist is frequently constructed with a single upper chord and a single lower chord. The overall strength of the truss joist structure is often substantially reduced by using an end bracket which can only be attached to the upper chord of the truss joist after a recess, a slot and a cross bore are drilled in the end portion of the chord. The slots, recesses and cross bores remove a substantial portion of the wood from the end of the upper chord and thereby reduce the overall strength of the truss joist assembly. Furthermore, since each slot, recess and cross bore requires a separate manufacturing step to incorporate it within the end of each upper chord, the cost of manufacture of each truss joist is thereby increased.

Truss joists are fabricated in standard lengths which correspond to the separation between two parallel walls. Although walls are designed to have a uniform spacing, the separation varies by typically 1 to 2 inches as a result of human error in construction and alignment. Prior art truss joists are designed to allow a certain amount of leeway with respect to variations in wall separation but this technique reduces the overall strength of the truss since the overlap of the truss with the support member on the wall varies significantly.

Contractors frequently experience severe difficulties when the wall spacing varies more than the truss joist can accommodate. In some circumstances a contractor may have to wedge the truss joist into position or try to increase the pressure between the walls in an attempt to increase the separation so that other truss joists might be more readily positioned.

Some truss joists allow for a small amount of adjustment by having an extra length upper chord. The upper chord can then be trimmed to the proper length in the field. This is not only an inefficient and time consuming procedure requiring extremely expensive and highly paid carpenters, but also typically reduces the strength of the truss. The design strength of the truss cannot be optimized because the actual end resting place of the upper chord upon the support structure cannot be accurately predicted.

Ordinarily some kind of plywood decking is attached to the upper surface of a truss joist in order to provide a floor or roof surface. Virtually all prior art truss joists include metal brackets which cover a portion of the top of the upper chord. These brackets frequently contain some metal cross pins which run laterally across the chord end in an area where the plywood decking is nailed. Due to the substantial amount of surface area covered by metal clips and metal pins, the process of attaching plywood sheeting to the upper surface of a truss joist can be a tedious trial and error procedure since nails striking metal on or in the upper chord must be removed and repositioned.

The majority of prior art truss joist designs require notch plates. These notch plates must either contain variable depth notches or each of the notches must be of a maximum depth to accommodate variations in the wall separation and to provide clearance for the end links of each truss joist. The requirement for a notch plate adds additional manufacturing steps and increases the probability of error during the installation of truss joists. Again, more wood is removed from load bearing elements associated with the truss joist and the overall structure is thereby weakened.

Many of the prior art truss joists are difficult to manufacture and assemble. Because of the requirement for slots, recesses and cross bores, all of which must be accurately sawed or drilled into the end of each truss joist upper chord and because of the careful alignment steps required to mate the hole in the flat end portion of an end link with the cross bore through the upper chord prior to inserting the metal cross pin, the cost of assembly of these prior art truss joists is comparatively high.

In addition, because of the continually varying stresses imposed upon a truss joist, it is possible that with time the friction fit between the metal cross pin, the cross bore and the hole in the end link may loosen and eventually allow the metal cross pin to fall free from the truss joist end bracket. This wear and ultimate deformation in the cross bore can be avoided by providing means for securing the cross pin in position or by providing other design features which eliminate this problem, but each of these design techniques further increases the overall cost of the end bracket assembly.

An additional difficulty with prior art truss joist designs is that one end bracket design is typically compatible only with a particular configuration of upper and lower chords. Composite wood and metal truss joists typically have a single horizontally oriented wooden upper chord and a single horizontally oriented wooden lower chord or a dual beam vertically oriented upper chord. In order to standardize manufacturing and assembly techniques as well as to permit utilization of the same fabrication machinery, it would be highly desirable to have a single truss joist end bracket design which would be compatible with both the single chord and double chord configuration. Furthermore, it would be desirable for this same end bracket design to be compatible with a truss joist having two upper chords and a single lower chord, or a single upper chord and two lower chords.

Examples of the foregoing prior art truss joist designs are shown and described in U.S. Pat. Nos.: 3,570,204 (Birkemeir), 3,268,251 (Troutner), 3,422,591 (Troutner), 3,330,087 (Troutner), 3,422,591 (Troutner), 3,813,842 (Troutner), 2,684,134 (Ruppel) and 3,137,899 (Troutner).

SUMMARY OF THE INVENTION

It is therefore a primary object of the present invention to provide a truss joist having an end bracket which can be attached to the upper chord after removing only a minimal amount of wood.

Another object of the present invention is to provide a truss joist having an end bracket which is adjustable in length.

Yet another object of the present invention is to provide a truss joist having an end bracket which does not require slots, recesses or cross bores in order to attach it to the upper chord.

Still another object of the present invention is to provide a truss joist having an end bracket which is readily adjustable during installation to fit exactly flush with the inner surface of a support member.

A further object of the present invention is to provide a truss joist having an end bracket containing no metal elements overlapping the upper surface of the upper chord, thus making available the full upper surface of the upper chord for attaching other structures by nailing.

Yet a further object of the present invention is to provide a truss joist which does not require a matching notch plate.

A still further object of the present invention is to provide a truss joist having an end bracket which can be attached to the upper chord quickly and easily since slots, recesses, cross bores or metal cross pins requiring careful alignment during installation are not required.

A yet further object of the present invention is to provide a truss joist having an end bracket which can be attached to a single horizontally oriented upper chord or to a pair of vertically oriented upper chords.

These and other objects of the present invention will become apparent to those skilled in the art as the description thereof proceeds.

Briefly stated, and in accord with one embodiment of the invention, a truss joist is supported at one end by a support member having an upper surface and an inner surface. The truss joist includes upper and lower chords having lower surfaces, first and second side surfaces, and terminal portions. A series of links connects the upper and lower chords and terminates tail. Thereafter, an adjustable top chord bearing end bracket, a flush chord bearing end bracket and an adjustable flush chord bearing end bracket, shown respectively in FIGS. 4–6, FIG. 7 and FIGS. 8–10 will be described in detail.

FIG. 1 illustrates a truss joist 10 having a top chord bearing end bracket 12 which is supported by support member or ledger plate 14. Ledger plate 14 is typically $2\frac{1}{2}$ to $3\frac{1}{2}$ inches wide and approximately 4 to 6 inches in height. It can either be attached to the vertical surface of a supporting wall or to the flat top surface of a wall. The section of truss joist 10 shown in FIG. 1 includes upper chord 16 and lower chord 18 which may be wood $2 \times 4$ inches. Upper chord 16 and lower chord 18 are rigidly connected together by end link 20 and a plurality of intermediate links such as links 22*a* and 22*b*. In a parallel chord truss joist all of the interconnecting links 22 are identical in design and length; in a tapered truss joist in which the spacing between the upper and lower chords increases from one end to the other, the length of each link differs. Each link has a flat end portion, such as end portion 24, which projects into a centrally located slot 26 in one of the truss joist chords. End link 20 is of the same design as links 22, except that end link 20 is typically somewhat shorter in length since one end of end link 20 is attached to end bracket 12 at a point below the lower surface of upper chord 16.

Figure 2:
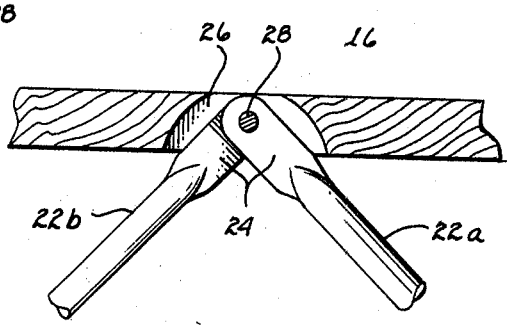

The flat end portions of the two adjacent links are securely fastened together by metal cross pins such as metal cross pin 28 which has a chamfered end. The chamfered end facilitates driving the cross pins through cross bores 30 and the apertures in the flat end portions of the various links. FIG. 2 shows more clearly the coupling of the links by metal cross pin 28 in slot 26.

Figure 3:
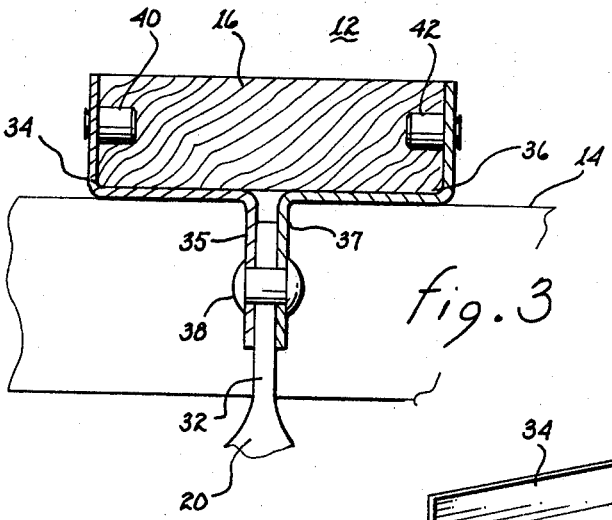

Referring now to FIGS. 1 and 3, flat end portion 32 of end link 20 lies between first L-shaped element 34 and second L-shaped element 36 of end bracket 12. End portion 32 is securely attached between first element 34 and second element 36 by securing means 38 which may be a rivet assembly or a nut-bolt washer combination. Cylindrical metal plugs 40 and 42 have chamfered ends and are typically approximately $\frac{3}{4}$ inches long. These plugs are attached to the sides of first and second elements 34 and 36 of end bracket 12 by tack welding, Tinnerman fasteners or by peening their rear surfaces against the outer surface of first element 34 and second element 36. Recesses having a diameter slightly less than the diameter of plugs 40 and 42 are drilled in the left and right sides of upper chord 16. During the truss joist assembly process, first element 34 and second element 36 are tapped into the holes in upper chord 16 until plugs 40 and 42 are fully inserted into the sides of upper chord 16. Plugs 40 and 42 securely attach end bracket 12 to upper chord 16. The strength of the terminal portion of upper chord 16 is not significantly reduced by this method of securing end bracket 12 since only a minimal amount of wood is removed therefrom.

Plugs 40 and 42 do not overlie the upper surface of ledger plate 14 so that the entire upper chord surface area above end bracket 12 can accommodate nails to secure plywood planking.

A portion of the tension force coupled to end bracket 12 by end link 20 is transmitted to upper chord 16 by plugs 40 and 42. An additional portion of the tension force transmitted by end link 20 is coupled through end bracket 12 directly to the upper surface of ledger plate 14, and thereby does not pass through upper chord 16. The presence of the extensive surface area of end bracket 12 directly beneath upper chord 16 actually reinforces the terminal portion of upper chord 16. In this manner the strength of upper chord 16 is increased by end bracket 12, whereas in virtually all the prior art brackets, the strength of the terminal portion of upper chord 16 is reduced due to the requirement for slots, recesses and cross bores.

The inner portion 44 of downwardly extending legs 35 and 37 which lie between securing means 39 and the inner surface of ledger plate 14 is designed to rest flush against the inner surface of ledger plate 14 in order to provide additional support and resistance to deformation by the tension forces coupled to end bracket 12 by end link 20.

Figure 4:
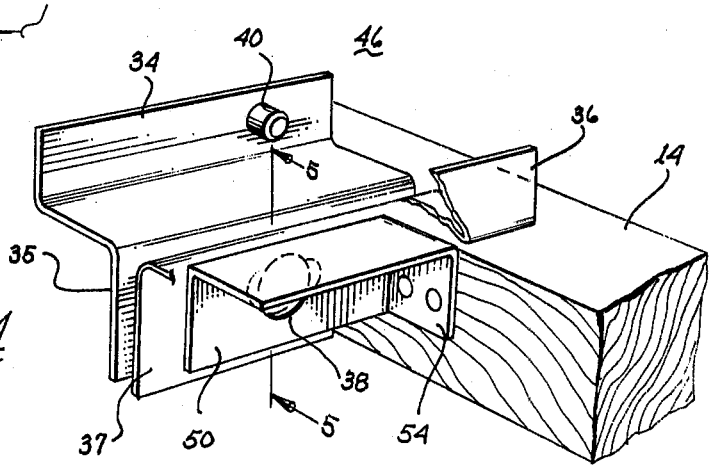
Figure 5:
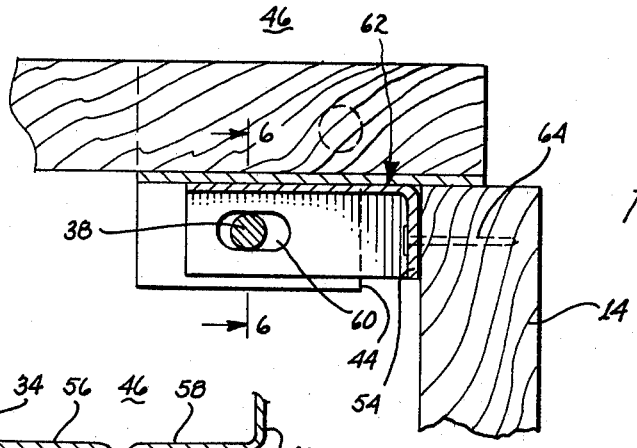
Figure 6:
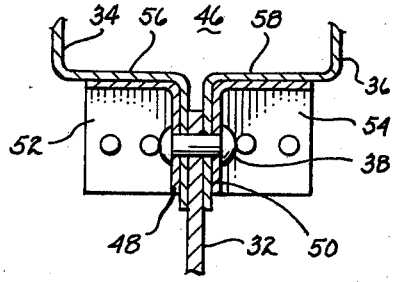

Because of the requirement that inner portion 44 be positioned flush against the inner surface of ledger plate 14 it was desireable to provide a length adjustment feature for the non-adjustable top chord bearing end bracket 12. FIGS. 4–6 illustrate an adjustable top chord bearing end bracket 46 which, except for the addition of adjustable bracket elements 48 and 50, is identical in design and operation to the nonadjustable top chord end bracket 12.

Adjustable bracket elements 48 and 50 are basically sheet metal plates bent at 90°. Further bending and cutting provides vertical end legs 52 and 54 which typically include two apertures to receive nails. The adjustable end brackets 48 and 50 are designed to lie flush against the lower surfaces or bottom members 56 and 58 of first L-shaped element 34 and second L-shaped element 36. Each adjustable bracket element contains an oval shaped aperture 60 through which securing means 38 passes to create an adjustable fit whereby light tapping with a hammer can move elements 48 and 50 to either shorten or lengthen the effective lengths of the terminal portion of upper chord 16. An adjustable bracket element such as element 50 is tapped until vertical surface 54 lies flush with the inner surface of ledger plate 14. Surface 54 is then secured by nails to ledger plate 14.

As can best be seen by referring to FIG. 5, the inner edges of first leg 35 and second leg 37 are offset from the inner surface of ledger plate 14. Ordinarily this would lead to great stresses being placed on adjustable end bracket 46 at the location indicated by arrow 62. Due to the presence of adjustable bracket elements 48 and 50, which are supported by nails 64 and securing means 38, the stresses existing in the area designated by arrow 62 are transferred to the inner surface of ledger plate 14 and to upper chord 16.

It has been found through experimentation that for an adjustable top chord bearing end bracket 46 constructed of 12 gauge steel, the offset between the inner surface of ledger plate 14 and the inner portion 44 of legs 35 and 37 can be as great as one inch for extemely heavy loads. Since there is one bracket on each end of the joist and each bracket is adjustable through a travel of 1 inch, the entire truss joist can be adjusted through a range of up to 2 inches. Obviously, for either lighter loads on the truss joist or for brackets of heavier gauge construction, this one inch adjustment may be increased substantially.

Figure 7:
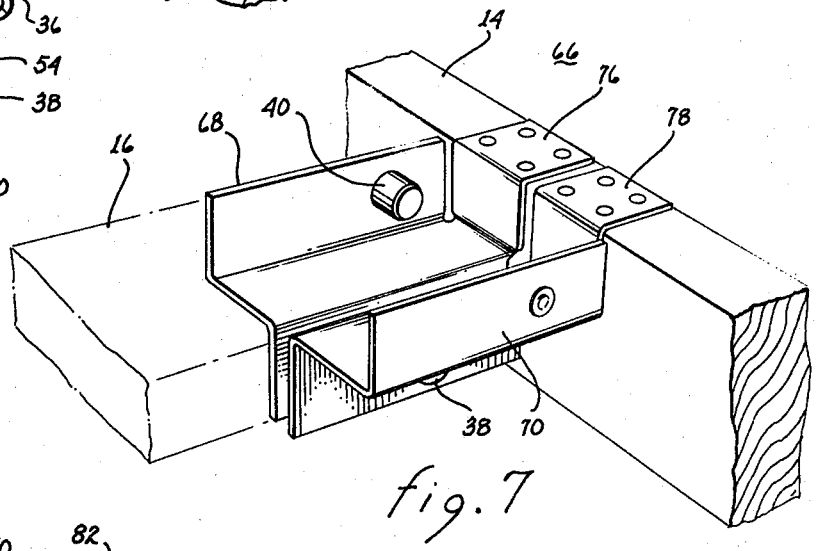

For certain applications, it is desirable to use a flush chord bearing end bracket 66 as is shown in FIG. 7. The use of this type of end bracket together with a truss joist such as that shown in FIG. 1 allows the top of upper chord 16 to lie flush with the upper surface of ledger plate 14. This flush positioning eliminates the need for blocking strips which must be placed on the upper surface of ledger plate 14 between the terminal portions of each adjacent truss joist to provide a uniformly flat surface for nailing plywood roofing or flooring.

Flush chord bearing 66 includes first L-shaped element 68 and second L-shaped element 70. Elèments 68 and 70 are secured to the inner surface of ledger plate 14 by horizontally oriented flanges 76 and 78, each of which may contain four apertures for receiving nails.

As was the case with end bracket 12 shown in FIG. 1, it is important that flush chord bearing end bracket 66 fit rather precisely up against the inner surface of ledger plate 14. This requirement for a close fit is acceptable for many applications, but is frequently a highly undesirable disadvantage since it is not always possible to maintain an exact separation between support members.

Figure 8:
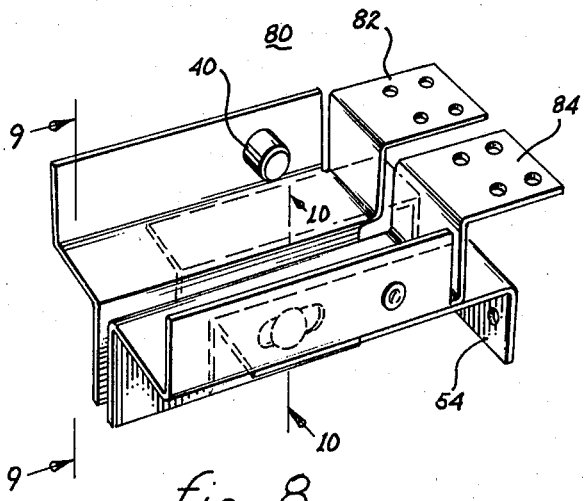
Figure 10:
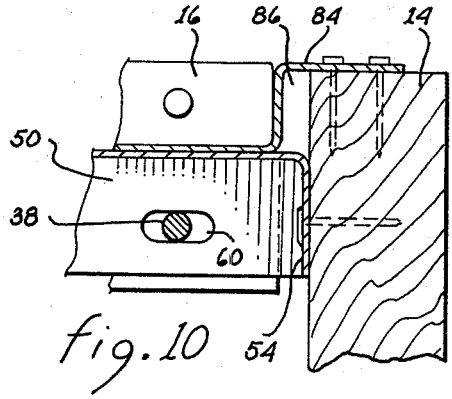
Figure 9:
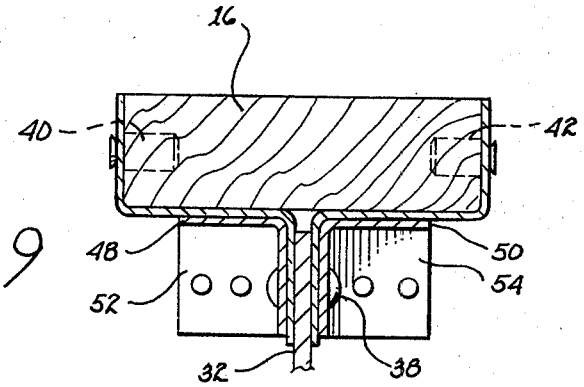

Because of the limitations on the use of flush chord bearing end bracket 66, it was desirable to design an adjustable flush chord bearing end bracket 80, which is shown in FIGS. 8, 9 and 10. Adjustable end bracket 80 includes adjustable bracket elements 48 and 50 having vertical end plates 52 and 54 of a configuration identical to that used with the adjustable top chord bearing end bracket 46 shown in FIG. 4. End bracket 80 further differs from fixed length end bracket 66 in that horizontally oriented flanges 82 and 84 are of a significantly greater length to accommodate the adjustable feature inherent in this bracket.

Adjustable end bracket 80 can typically be adjusted up to an inch in length for high load applications. FIG. 10 shows adjustable end bracket 80 when it is adjusted approximately ½ inch outward toward the inner surface of ledger plate 14. Upper chord 16 does not reach the inner surface of ledger plate 14; there is a noticeable gap 86 between end bracket 80 and the inner surface of ledger plate 14. The length of horizontally oriented flanges 82 and 84 is sufficient to allow a substantial amount of overlap with the upper surface of ledger plate 14 even when gap 86 is of the maximum allowable length. The nail hole apertures in the top of these horizontally oriented flanges are designed to overlie the upper surface of ledger plate 14 to allow attachment by nails for the full range of adjustment.

One of the final installation steps for truss joist 10 having adjustable end bracket 80 would be for the installer to lightly tap bracket ends 52 and 54 of adjustable bracket elements 48 and 50 into flush alignment with the inner surface of ledger plate 14. The adjustable bracket elements are then nailed into position. In a manner similar to that previously explained with reference to adjustable top chord bearing end bracket 46, adjustable bracket elements 48 and 50 transfer the vertical loads imposed upon end bracket 80 around gap 86 between the bearing and the inner surface of ledger plate 14 and thereby provide substantially greater bracket strength and rigidity.

It will be apparent to those skilled in the art that the disclosed flush and top chord bearing end bracket designs may be modified in numerous ways and may assume various embodiments other than those preferred embodiments specifically set out and described above. By way of example, the degree of adjustability of the adjustable embodiments may be either reduced or substantially increased from that disclosed by the use of larger, higher strength brackets. Furthermore, all of these various bracket designs are useable not only with 2 × 4 inch single horizontally oriented upper and lower chords, but also are useable with 4 × 6 inch wooden chords and wooden or metal materials of any other dimensions which might be used in the manufacture of truss joists. These bracket designs cannot only be attached to truss joists having single horizontally oriented upper and lower chords as was disclosed in FIG. 1, but could also be used with various combinations of single horizontally oriented chords and two element vertically oriented chords. When the brackets are used with dual vertically oriented chords, one of the plugs in each bracket half would be anchored to each of the two vertically oriented upper chords.

In another embodiment a truss joist having a top chord bearing end bracket on one end could be attached to a ledger plate mounted on the side of a first wall, while the other end of the truss could be secured to a ledger plate mounted on top of a second wall by a flush chord bearing end bracket.

Additionally, the securing means for attaching the end link to the end bracket could be a nut and bolt combination, rivets or spot welds. The number of nail apertures in the adjustable bracket elements and in the horizontally and vertically oriented flanges could also vary. An adhesive material, such as epoxy glue, or nails could be used in place of plugs 40 and 42 to attach L-shaped elements such as elements 68 and 70 to the sides of upper chord 16. Cross pins might also be used for the same purpose. Accordingly, it is intended by the appended claims to cover all such modifications of the invention which fall within the true spirit and scope of the invention.

What is claimed is:

1. A truss joist supported at one end by a support member which includes an upper surface and an inner surface, said truss joist comprising in combination:

a. an upper chord having a lower surface, first and second side surfaces, and a terminal portion;
b. a lower chord;
c. a series of links connecting said upper and lower chords, said series of links including an end link connected to said lower chords and extending upwardly toward the terminal portion of said upper chord, said end link having an end portion;
d. an end bracket including
   i. a channel member having a lower surface positioned below and in contact with the lower surface of said upper chord and first and second side surfaces positioned adjacent the first and second side surfaces of said upper chord;
   ii. receiving means disposed below and connected to said channel member and to said end link for connectively receiving the end portion of said end link and for transferring forces from said end link to said channel member;
e. securing means for connecting the end portion of said end link to the receiving means of said end bracket;
f. connecting means for securing said channel member to said upper chord; and
g. coupling means for transferring forces from said end bracket to the upper surface of said support members.

2. The truss joist of claim 1 wherein said receiving means comprises at least one downwardly extending plate.

3. The truss joist of claim 1 wherein the end portion of said end link comprises a flat portion of predetermined width, and wherein said receiving means comprises two downwardly extending plates separated by at least the width of said flat portion of said end link.

4. The truss joist of claim 1 wherein said bottom member comprises a first and a second plate symmetrically disposed about the center line of said upper chord and situated adjacent to the lower surface of said upper chord.

5. The truss joist of claim 4 wherein said receiving means comprises:
a. a first downwardly extending legs connected to said first plate; and
b. a second downwardly extending legs connected to said second plate;
whereby the spacing between said first and said second legs is equal to or greater than the thickness of said end portion of said link.

6. The truss joist of claim 1 wherein said securing means comprises a welded bond between said end portion of said end web and said receiving means.

7. The truss joist of claim 1 wherein said securing means comprises an adhesive bonding material disposed between said end portion of said end web and said receiving means.

8. The truss joist of claim 5 wherein
said end portion of said end link includes an aperture;
said first and said second downwardly extending legs each include an aperture; and
said securing means comprises a fastener passing through the corresponding apertures in said first leg, said end portion of said end web, and said second leg for coupling said end link to said receiving means.

9. The truss joist of claim 8 wherein said fastener includes a rivet.

10. The truss joist of claim 8 wherein said fastener includes a nut and bolt combination.

11. The truss joist of claim 1 wherein said connecting means includes an adhesive bonding material placed between said bottom member of said end bracket and the lower surface of said upper chord.

12. The truss joist of claim 1 wherein
said bottom member of said end bracket further includes first and second side members adjacent to the first and second side surfaces of said upper chord;
said connecting means includes at least one plug extending from said first and said second side members of said bottom member; and
said first and said second side surfaces of said upper chord each include at least one recess for receiving said plug.

13. The truss joist of claim 1 wherein
said first and said second side members of said bottom member include at least one aperture; and
said connecting means includes at least one nail for securing each of said first and said second side members of said bottom member to said upper chord.

14. The truss joist of claim 1 wherein
said terminal portion of said upper chord further includes a cross bore extending through said chord from said first side surface to said second side surface;
said first and second side members of said bottom member include an aperture;
said connecting means comprises a cross pin passing through the apertures in said first and second side members of said bottom member and said cross bore for securing said end bracket to said upper chord.

15. The truss joist of claim 8 further comprising:
at least one adjustable bracket means for transferring forces from said bottom member to the inner surface of said support member, said bracket means including an aperture for receiving said securing means, the aperture in said bracket means being larger in at least one dimension than the apertures in said first and second downwardly extending legs, whereby said terminal portion of said upper chord is adjustable in length.

16. The truss joist of claim 15 wherein each of said first and second plates of said bottom member further include an inner edge adjacent to the inner surface of said support member and wherein said coupling means includes a first and a second horizontal flange coupled to the inner edges of said first and second plates and extending upwardly from said first and second plates and laterally over the upper surface of said support member whereby said truss joist is supported at one end by said support member.

17. The truss joist of claim 15 wherein said first and second plates include a lower surface and a terminal portion overlying the upper surface of said support member, and said coupling means comprises the terminal portion of the lower surface of said first and second plates.

* * * * *